United States Patent [19]

Mosimann et al.

[11] 4,117,663

[45] Oct. 3, 1978

[54] ELECTRONIC WATCH WITH TIME CORRECTION SYSTEM

[75] Inventors: Peter Hubert Mosimann, Bellmund; Hans Rudolf Sutter, Pieterlen, both of Switzerland

[73] Assignee: Bulova Watch Company, Inc., Flushing, N.Y.

[21] Appl. No.: 786,873

[22] Filed: Apr. 12, 1977

[30] Foreign Application Priority Data

Apr. 23, 1976 [CH] Switzerland ..... 5101/76

[51] Int. Cl.$^2$ ..... G04B 27/08

[52] U.S. Cl. ..... 58/85.5; 58/23 R

[58] Field of Search ..... 58/23 BA, 23 AC, 23 R, 58/85.5

[56] References Cited

U.S. PATENT DOCUMENTS 3,967,442 7/1976 Berney ..... 58/85.5

*Primary Examiner*—Robert K. Schaefer
*Assistant Examiner*—Leonard W. Pojunas, Jr.
*Attorney, Agent, or Firm*—Michael Ebert

[57] ABSTRACT

An electronic watch wherein pulses from a high-frequency standard are converted by a frequency divider into low-frequency timing pulses which are supplied to a stepping motor to advance the hands of the time display. In order to automatically effect a rapid correction of the seconds hand display when it deviates from precise time, a system is provided that includes an actuating element accessible to the user of the watch and operatively coupled to a switch connected through a reset line to several of the last stages of the frequency divider to effect a reset thereof upon activation of the switch. Also reset when the switch is activated is a reference counter supplied with pulses by the frequency divider. The divider feeds pulses by way of a logic circuit to the stepping motor and to a synchronous counter which is maintained in synchronism with the time display. A comparator circuit determines whether a deviation exists between the two counters and acts to govern the number of pulses per unit of time that the logic circuit supplies to the stepping motor and to the synchronous counter to an extent correcting for the deviation. The logic circuit is so connected to the outputs of the resettable divider stages that the transmission of pulses from the divider to the two counters can only be carried out during a pulse transfer period whose duration is no longer than the last quarter of the longest duration pulse period of the divider. Resetting of the frequency divider is inhibited during the transfer period.

15 Claims, 2 Drawing Figures

ELECTRONIC WATCH WITH TIME CORRECTION SYSTEM

BACKGROUND OF INVENTION

Figure 1:
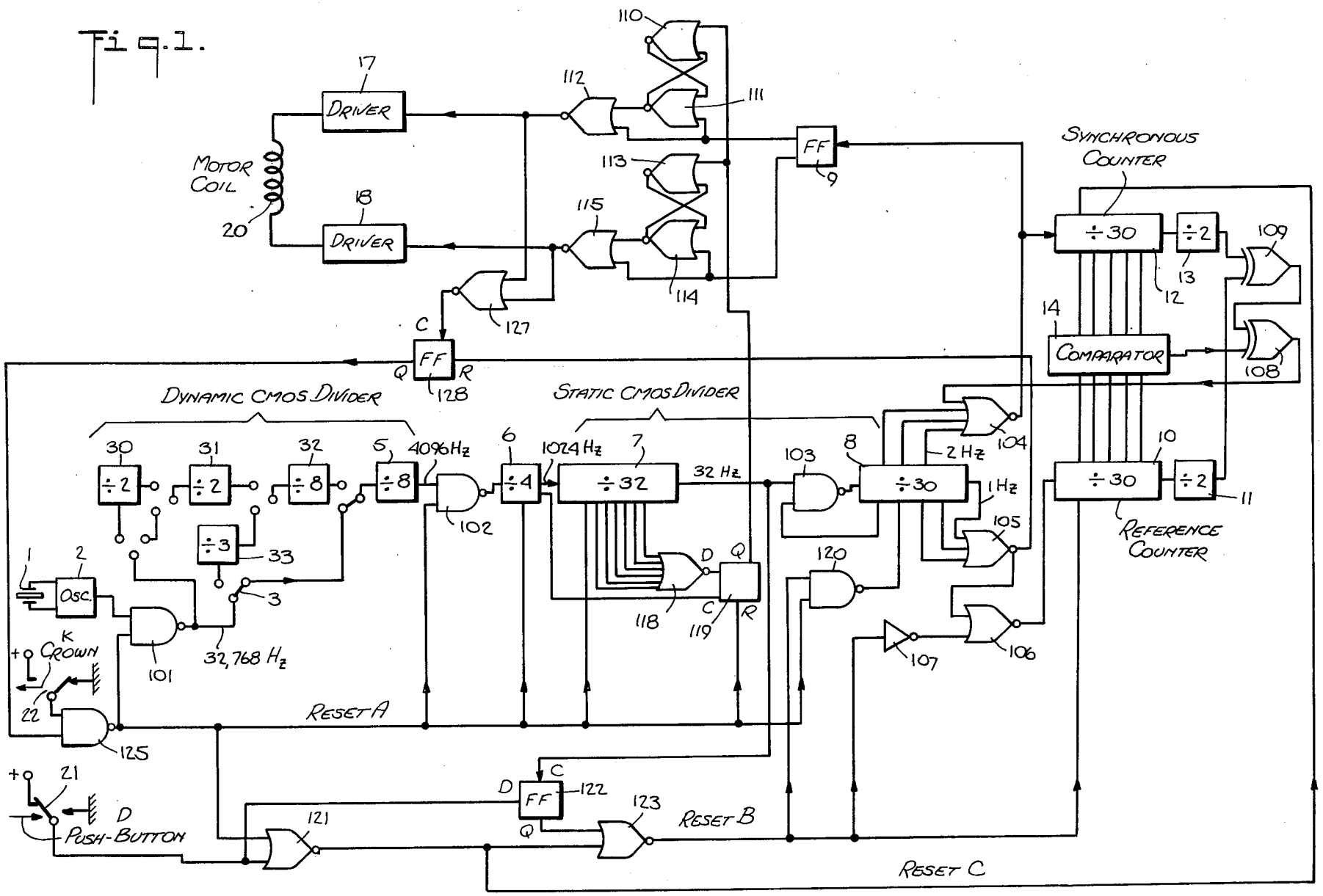

This invention relates generally to electronic timepieces having an analog time display whose hands are operated by a pulse-driven stepping motor, and more particularly to a timepiece of this type which includes a system adapted to effect rapid correction of reading errors in the order of plus or minus 30 seconds or less.

Electronic watches are known which display time in analog form by means of hour, minute and seconds hands that are advanced by a stepping motor driven by low-frequency pulses derived by a multi-section frequency divider from a high-frequency crystal-controlled time base or frequency standard. Though modern watches of this type are highly accurate, after one or more weeks of continuous operation, they usually deviate plus or minus a few seconds from the precise time.

With a view to effecting a fast correction for relatively small deviations in the seconds reading of such electronic watches, Swiss Pat. No. 556,055 and U.S. Pat. No. 3,967,442 disclose a correction system for this purpose which includes an actuating button or element accessible to the user. This element, when actuated, causes the seconds hand to assume its proper position. The system is provided with a reference counter that is coupled to the output of the frequency divider and is resettable by the actuating element. Also provided is a synchronous counter, this counter and the stepping motor for the display being supplied through a logic circuit with pulses produced by the divider whereby the synchronous counter is maintained in step with the time display. The state of the synchronous counter is compared with that of the reference counter in a comparator circuit which acts, in the case of a deviation therebetween, to govern the number of pulses per unit of time applied through the logic circuit to the stepping motor and to the synchronous counter to effect the necessary correction in the displayed time.

Thus with a fast correction system as disclosed in the above-noted patents, it is no longer necessary, where a small deviation exists in the time display, to first operate the crown of the watch to arrest the seconds hand at its zero position (12 o'clock) and then wait to hear a reference time signal (radio or telephone) before again operating the crown to restart the watch. The prior art fast correction system is intended to simplify the time setting of the watch, for it is only necessary when hearing the time reference signal to momentarily operate the actuating element or button to automatically bring the seconds display into step with the time reference signal without any additional operations or expedients.

In principle, it is possible with the correction arrangement disclosed in the above-noted patents, after resetting the reference counter, to supply by means of the comparator circuit additional pulses from the divider to the synchronous counter and to the display to correct for a minus deviation in the seconds reading or to inhibit the transmission of pulses from the divider to the synchronous counter and to the display to correct for a plus deviation.

The prior art correction system is intended to take care of relatively small deviations of plus or minus 30 seconds from precise time, this being sufficient for modern electronic watches, particularly those which include a quartz-crystal frequency standard whose monthly rates usually remain within these tolerances. The great advantage of this fast correction system is that the user can make the necessary correction not more than once a week or even less frequently, simply by operating the actuating element without having to stop and restart the watch.

In practice, however, the prior art correction arrangement outlined above does not result in a well-functioning, trouble-free device. Indeed, handsetting of the watch can give rise to inaccuracies. For example, when, after setting the hands, the crown is pushed in to restart the watch, the resumption of the time display will be off by one second; for the stepping motor must await the next seconds pulse from the last stage of the frequency divider. Such inaccuracies are unacceptable for a quartz crystal electronic watch or any other highly accurate timepiece.

SUMMARY OF INVENTION

In view of the foregoing, it is the main object of this invention to provide a correction system for an electronic watch to effect a quick correction of small reading errors in the order of plus or minus 30 seconds or less, which correction system overcomes the drawbacks of prior art systems and fully realizes the potential advantages thereof.

More particularly, it is an object of this invention to provide, in addition to the switch operatively coupled to the actuating element for the fast correction system, a switch operatively coupled to the time-setting crown of the watch, these switches being connected via reset lines to several of the last stages of the frequency divider.

A significant feature of the invention is that the logic circuit, which is coupled to the frequency divider and feeds pulses to the synchronous counter and to the time display, functions to define a pulse transfer period, the inputs of the logic circuit being connected to the outputs of the resettable frequency divider stages such that the transmission of pulses from the frequency divider can be carried out only during the last quarter of the longest duration pulse period of the frequency divider, the logic circuit including suppression means to inhibit a reset of the frequency divider during the pulse transfer period.

In resetting the last stages of the frequency divider, one thereby obviates the drawbacks of prior art correction systems. But automatic reset of the frequency divider does not, in and of itself, lead to an accurate operation of the fast correction system; for when one restarts the watch after setting its hands, there can result, depending on the precise moment the reset pulse is applied as well as on the phase angle of the frequency divider, the generation of false pulses. These false pulses may, for example, disturb the synchronism of the reference counter with the synchronous counter or the synchronism between the synchronous counter and the time display.

These difficulties are obviated in a system in accordance with the invention by a logic circuit functioning as a decoder that defines a pulse transfer period. the term "pulse transfer period" refers to a small segment of a complete period during which the transfer of pulses or pulse edges is possible, within which segment the reset of the divider stage is inhibited. Thus the logic circuit acts in the remaining portion of the complete period to prevent the transfer of pulses to the two counters and to the time display for an interval whose duration is at least three quarters the duration of a full period. During this relatively long interval when pulse transfer is prevented, it is therefore possible to carry out reset actions without the danger of generating false pulses.

In other words, the full period during which pulse transfer is possible is subdivided into (a) an inhibition interval or pulse transfer period which permits pulse transfer but inhibits reset and (b) a disabled inhibit interval in which pulse transfer is prevented and reset is permitted. The disabled inhibit interval during which zero resetting of the frequency counter is not inhibited should be at least three times as long as the pulse transfer period or inhibition interval, so that there is then available the longest possible time for carrying out any kind of required operation.

In an arrangement according to the invention, the relative durations of the non-inhibited time interval and the inhibition time interval is determined by proper choice at the connections between the inputs to the pulse transfer decoding logic and last stages of the frequency divider. It is advantageous to so choose these connections that the disabled inhibit interval is 7/8th and the inhibition period is 1/7th of a second.

It then becomes possible for the user of the watch equipped with a fast correction system in accordance with the invention, during the 7/8th of a second following the last change in the seconds display, to stop the watch without interfering with accurate time setting.

Furthermore, in order to avoid a resetting of the frequency divider stages and eliminate any outside intervention as long as pulses can be transferred to the time display, the system in accordance with the invention includes inhibiting logic means for this purpose. Such inhibiting logic means are especially appropriate to an electronic watch in which the hands are operated by a pulse-driven stepping motor.

In addition, the system in accordance with the invention includes a decoding circuit whose inputs are connected to the outputs of several stages of the frequency divider, the circuit functioning to define exactly the width of the pulses transferred to the time display. To this end, the decoding logic serving to define the pulse transfer period is connected to the outputs of stages in the final section of the multisection divider, whereas the decoding logic acting to define the width of the pulses transmitted to the display is connected to outputs of the stages of the section of the divider immediately preceding the final section thereof. By means of the first-mentioned decoding logic, it becomes possible to accurately position the trigger pulses for operating the time display, whereas the second-mentioned decoding logic delivers pulses at highly regular intervals whose edges are coincident with the trailing edges of the time display pulses.

As a further security against improper manipulation of the operating element of the watch, the switch operated by the actuating element for effecting fast correction of the seconds reading and the switch operated by the crown for setting the hands of the watch are so coupled by way of a logic circuit to the reset connections of the reference counter and the synchronous counter that these counters can be reset only by simultaneous activation of both switches. It then, as a practical matter, becomes virtually impossible to unintentionally set to zero both counters. The setting procedure whereby both switches are simultaneously activated is actually necessary only when initially placing the watch into operation or when replacing the watch battery.

Moreover, it is important that the operation of the actuating element to effect a fast correction of the seconds hand not give rise to a significant time delay. The danger of a time delay can be avoided if, after resetting the reference counter and the last stages of the frequency divider, a relatively high-frequency pulse derived from the frequency divider is used to again enable the reset stages. It is usually sufficient for this purpose to use a 32 Hz pulse.

The preferred arrangement for avoiding an unacceptable time delay requires the use of at least one flip-flop for resetting the reference counter and the several stages of the frequency divider, which flip-flop has one input connected to the switch activated by the actuating element and another input to the 32 Hz output of the frequency divider. This flip-flop is set to a given condition when the actuating element is operated by the user to activate the switch associated therewith, which condition leads to a reset of the frequency divider and the reference counter after the condition is changed by the next 32 Hz pulse. In this way, the reset stages are caused to resume counting and to thereby define the beginning of a new output pulse.

OUTLINE OF DRAWINGS

Figure 2:
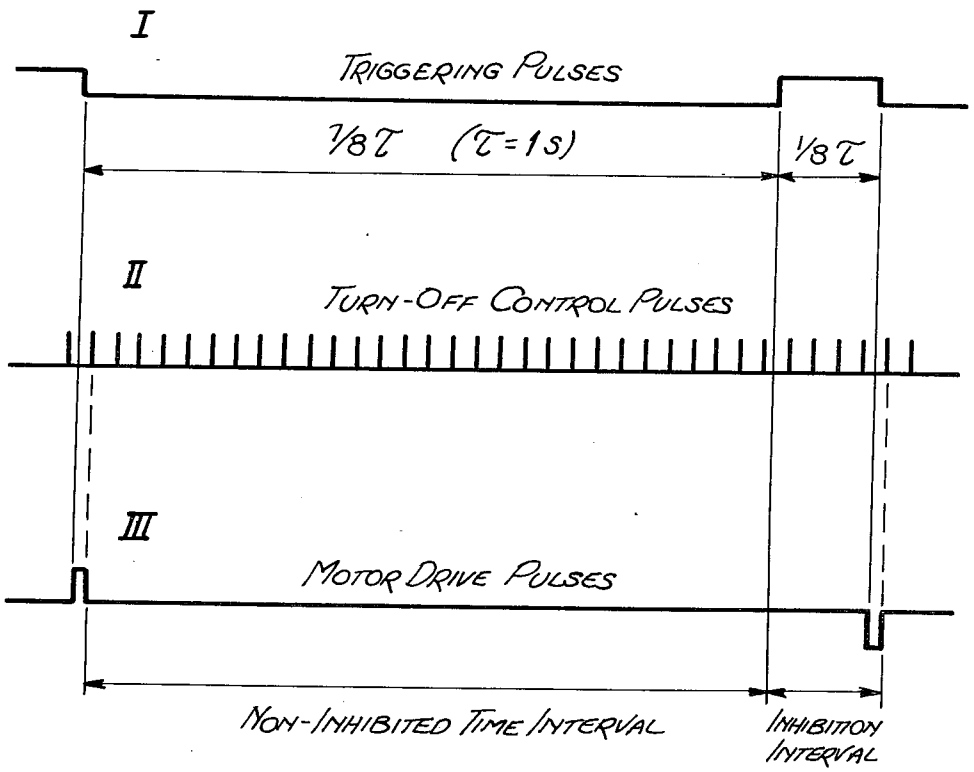

For a better understanding of the invention as well as other objects and further features thereof, reference is made to the following detailed description to be read in conjunction with the accompanying drawings, wherein:

FIG. 1 is a block diagram of a preferred embodiment of a fast correction system in accordance with the invention; and FIG. 2 shows three interrelated time diagrams (I, II and III), which are explanatory of the behavior of the system.

DESCRIPTION OF INVENTION

The Circuit Arrangement

The electronic watch which incorporates a system in accordance with the invention for correcting relatively small deviations in the time display not exceeding plus or minus 30 seconds is of the analog type and includes moving hands driven by a small stepping motor that advances the seconds hand one step per second. The minute and hour hands are mounted on a separate arbor and are driven in a conventional manner through a suitable gear train. Setting of the watch hands is effected by a crown.

As shown in FIG. 1, the time base for the electronic watch is a high-frequency standard constituted by a quartz-crystal element 1 connected to an oscillator circuit 2. In one actual embodiment of the invention, the crystal-stabilized oscillator generates an output wave having a frequency of 32,768 Hz.

The output wave from oscillator 2 is shaped into pulses and applied to one input of a NAND gate 101. The output of NAND gate 101 is fed through hard-wired, serially-connected contacts 3 and 4 to a frequency divider constituted by a train of divider sections 5, 6, 7 and 8.

Divider section 5 comprises three binary stages which operate in a dynamic mode and are characterized by extremely small current consumption as compared to conventional dividers. On the other hand, divider sections 6, 7 and 8 are constituted by binary stages which are of the static CMOS type. All of these circuits are integrated on a single chip. It is advantageous in an electronic watch to integrate all circuits thereof, including the logic circuits and the driver stages on the same chip by means of large scale integration techniques.

In divider section 5, pulses having a frequency of 32,768 Hz derived from gate 101 coupled to oscillator 2 are divided by a factor of 8 to produce pulses at a rate of 4096 Hz. These output pulses are fed to the next divider section 6 which divides the pulses by 4 to produce a 1024 Hz output. These pulses are fed to divider section 7 which divides by 32 to produce a 32 Hz output. The 32 Hz pulse output of section 7 is applied to the final divider section 8 which divides by 32 to produce output.

Hence the last binary stage of divider section 8 yields a 1 Hz output, this being applied to one input of a NOR gate 105. The next to the last stage of divider section 7 yields a 2 Hz output, and this is applied to one input of a NOR gate 104 whose other inputs are connected to corresponding stages in divider section 8. The output of NOR gate 105 is connected to one input of a NOR gate 106 whose second input is connected through an inverter 107 to a reset line B.

Between dynamic divider section 5 and static divider section 6 is interposed a NAND gate 102. The output of gate 102 goes to the input of divider section 6, one input of this gate being connected to the output of section 5. The second input of NAND gate 102 and the second input of NAND gate 101 are both connected to a reset line A, which assures an error-free transmission of the pulses counted by divider section 5 and a dependable resetting of the first stage of divider section 6. NAND gate 103 interposed between divider sections 7 and 8 of the static CMOS divider carries out a similar function.

The three NOR gates 104, 105 and 106 perform a special function; for together they form a decoding logic circuit by means of which a pulse transfer period is defined at the end of the 1 Hz period of the last dividing stage in the final divider section 8. During this period, the control pulses from the frequency divider are further transmitted in a manner to be later described.

These control pulses are not relatively long pulses of a predetermined time duration, but short pulses of an uncritical duration whose purpose is merely to change the state of the flip-flops actuated thereby. Hence of importance is only the exact location of the edges of the control pulses which can be positive or negative and which must be situated within the inhibiting period previously mentioned.

It will be seen in FIG. 1 that the output pulses of NOR gate 104 are applied to the input of a synchronous counter 12 which divides by 30, while the output pulses of NOR gate 106 are applied to the input of a reference counter 10, which also divides by 30. In addition, the output of NOR gate 104 delivers pulses to a flip-flop 9. An additional counter stage 11 coupled to the output of reference counter 10 divides by 2 so that the output thereof divides the input pulse rate to reference counter 10 by 60. Similarly, an additional counter stage 13 coupled to the output of synchronous counter 12 divides by 2, so that the output of stage 13 divides the input pulse rate to synchronous counter 12 by 60.

The respective divider stages of reference counter 10 and those in synchronous counter 12 are connected to a comparator circuit 14, the output of which is connected to one input of an EXCLUSIVE OR gate 108. The other input to gate 108 is connected to the output of an EXCLUSIVE OR gate 109 whose two inputs are connected to the respective outputs of the divide-by-two stages 11 and 13.

A logic circuit group constituted by NOR gates 110, 111 and 112 associated with the stepping motor constitutes a flip-flop which initiates a positive motor pulse in one state, and while changing to the other state concludes the positive motor pulse. Another logic circuit group constituted by NOR gates 113, 114 and 115 carries out the same function, except that it acts to generate negative motor pulses. Thus the two logic circuit groups act as a control network for the stepping motor.

The stepping motor for driving the seconds hand of the watch includes a field coil 20 and is of the so-called bi-polar motor type. The rotary motor, in response to the alternate positive and negative pulses, is caused to advance one step per pulse. Motor coil 20 is supplied with negative and positive pulses through conventional driver stages 17 and 18, driver stage 17 being coupled to the output of NOR gate 112, and driver stage 18 to the output of NOR gate 115.

Also included in the watch is a programmable decoder circuit having a NOR gate 118 for exactly defining the length of the motor-drive pulses. NOR gate 118 has a plurality of inputs connected to the respective outputs in the corresponding stages of the frequency divider section 7. The exact arrangement of these connections depends on the desired position of the pulse edge which, through a flip-flop 119, resets the two groups of motor pulse NOR gates (group 110 to 112 and group 113 to 115).

The programming of this pulse-length decoding circuit depends on the characteristics of the stepping motor actually employed. This can be established by proper selection of the connections between the outputs of the stages of frequency divider section 7 and the inputs to gate 118. In practice, this selection is effected by the last metal mask operation during the manufacture of the integrated circuit chip.

A similar adaptation to given operating conditions is employed for activating certain stages of the dynamic CMOS divider sections. It will be seen in the circuit diagram that in the dynamic CMOS divider, in addition to divider section 5, there are also sections 30, 31, 32 and 33 which are passive. These passive sections can be activated, if necessary, by using the corresponding metal masks during the manufacture of the integrated circuit so that the same chip can be used in conjunction with watches having a time base whose frequency is different from the 32,768 Hz crystal frequency given in the above-described example, such as a frequency standard using a crystal-stabilized frequency of 1,048,576 Hz.

With other time base frequencies, instead of connections at contacts 3 and 4, as shown in FIG. 1, one can provide connections between the output of NOR gate 101 and divider section 30 (divide by 2) and also between section 31 (divide by 2) and section 32 (divide by 8). Thus if we start with a time base of 1,048,576 Hz and divide by 2 in section 30, this gives a pulse rate output of 524,288 Hz; and if we then divide this by 2 in section 31, this yields 262,144 Hz. Dividing this by 8 in section 32 gives a pulse rate output of 32,768 Hz which is then fed into section 5 which continues to function in the manner previously described.

Fast correction of the watch is effected by a pushbutton or other actuating element mounted in the case of the watch and operated by a finger nail, a ball point pen or similar means. The push-button is mechanically linked to a switch arm 21 of a switch, which, when actuated, moves in the direction indicated by arrow D to engage a fixed contact by which it is connected temporarily to ground. Switch arm 21 normally engages a fixed contact connected to the positive side of a d-c voltage source.

Switch arm 21 is connected to one input of a NOR gate 121, as well as to an input of a flip-flop 122 coupled to the 32 Hz output of divider section 7. The outputs of NOR gate 121 and of flip-flop 122 are connected to the respective inputs of NOR gate 123 whose output supplies reset line B. An additional reset line C connected to the output of NOR gate 121 leads to synchronous counter 12.

It is, of course, also necessary to provide means bringing about a reset of the frequency divider when resetting the hands of the watch, such that after a restart of the watch, the seconds hand takes its first step exactly after one second. For this purpose, a switch arm 22 of a second switch is provided which is activated by pulling out the crown of the watch in the direction indicated by arrow K, and caused thereby to shift away from its normal grounded contact position to engage a fixed contact having a positive potential applied thereto. Switch arm 22 is connected to an input of the NAND gate 125 whose output supplies reset line A.

Operation of Circuit

The time base constituted by quartz crystal 1 and oscillator 2 yields a sinusoidal wave whose frequency we shall assume is 32,678 Hz. This is applied to NAND gate 101 which acts as a pulse shaper to produce rectangular pulses at the same frequency. These relatively high-frequency time base pulses are divided down in the succession of divider sections 5, 6, 7 and 8 to yield timing pulses at a rate of 1 Hz.

The decoding logic circuit constituted by NOR gates 104, 105 and 106, after 7/8th's of a second, closes the transmission path to reference counter 10, which is advanced one step per second. Comparator circuit 14 is now triggered and acts through gate 108 to open gate 104 in the decoding circuit to advance synchronous counter 12 on step and to simultaneously transmit a signal to flip-flop 9 to initiate the motor control pulse.

Considering the advance of synchronous counter 12, as just described, comparator circuit 14 senses the coincidence between synchronous counter 12 and reference counter 10, and by way of gate 108, inhibits the transmission of supplementary pulses through gate 104 to flip-flop 9 and to synchronous counter 12.

When flip-flop 9 is being set, it acts to set one of the two logic circuit groups in the control network for the stepping motor; that is, the group constituted by NOR gates 110, 111, 112, or the group constituted by NOR gates 113, 114, 115, one group providing positive drive pulses, and the other negative drive pulses to motor coil 20.

It is essential that the pulse edge which turns off the stepping motor be located within the last eighth of the period of the 1 Hz pulse derived from the last divider section 8 in the divider chain. The accuracy with which one locates the position in time of the pulse edge which turns off the motor is very important.

As noted previously, the pulses for resetting the two logic circuit groups 110, 111, 112, and 113, 114, 115 are derived from divider section 7. The input pulse rate to this section is 1024 Hz, which affords a high resolution rate for the time-positioning of the reset pulse edges. The connections between divider section 7 and gate 118 coupled thereto can be chosen so that the total duration of the motor pulse is 4,888 ms, this duration being determined by the interval between the setting and the resetting of the motor pulse logic circuit groups.

Thus motor drive coil 20 receives through its associated drivers 17 and 18 short negative or positive drive pulses. Drivers 17 and 18 act to short-circuit motor coil 20 in the intervals between the drive pulses. This serves to improve the dynamic behavior of the stepping motor.

We will now assume that the watch is slow by a few seconds (between 0 and 29 seconds). To effect a correction for this condition, the user operates the push-button in the direction indicated by arrow D to ground switch arm 21 of the first switch, thereby causing flip-flop 122 to produce a short reset pulse which is transmitted by reset line B to divider section 8, as well as to reference counter 10. The next 32 Hz pulse emerging from divider section 7 effects a restart of divider section 8 and of reference counter 10 coupled thereto.

Comparator circuit 14 now senses that because the watch is slow, the state of reference counter 10 is higher than that of synchronous counter 12. Through gates 108 and 104, the decoding action is so influenced that the motor now receives two pulses per second until such time as comparator circuit 14 again senses a state of coincidence between synchronous counter 12 and reference counter 10.

If, on the other hand, the watch is fast by a few seconds, switch arm 21 is activated by the push-button, and comparator circuit 14 will then sense that there is an excessive count in synchronous counter 12 after the reset and restart of divider section 8 and reference counter 10 coupled thereto. As a consequence, gate 104 will be inhibited until a state of coincidence exists between the two counters 10 and 12. During this inhibition period, no motor drive pulses will reach flip-flop 9.

We shall now assume that the user of the timepiece wishes to arrest its operation in order to set the hour and minute hours, after which he restarts it. This is effected by pulling out the crown to its farthest position in the direction indicated by K to cause switch arm 22 of the second switch to engage the fixed contact having a positive potential impressed thereon to change the potential on reset line A serving to reset divider sections 6, 7 and 8.

However, this resetting of the divider cannot be carried out during the inhibition interval of ⅛th of a second defined by decoding logic gates 104, 105, 106. Moreover, provision is made to inhibit the reset function during the pulse transfer period. Such inhibition is effected by means of the NOR gate 127, the flip-flop 128 and the NAND gate 125.

Without this security measure, actuation of switch arm 22 at the moment a motor pulse is transmitted under certain circumstances could activate synchronous counter 12. However, the motor drive pulse delivered from the flip-flop could be shortened to an extent that the motor will no longer carry out an operation leading to a loss of synchronism between synchronous counter 12 and the seconds hand. Pushing in the crown results in resetting of switch arm 22 to again ground it, reactivating divider sections 6, 7 and 8, and thereby starting the cycle for the formation of the next 1 Hz output pulse.

A particular problem arises when it becomes necessary to set the hands, such as upon placing the watch into service for the first time or upon replacement of the battery. In these situations, the frequency divider and the two counters of the correction circuit must be zero set. In order to avoid improper operation, it is essential that when the crown is pulled out to its position for setting the hands, the pushbutton for the fast correction device is operated at the same time so as to simultaneously actuate switch arms 21 and 22.

In pulling out the crown to set the hands, attention must be paid to the seconds hand which must then be at "0" (12 o'clock). This is essential; for otherwise there will be no tracking between the seconds hand and the synchronous counter 12 after restarting the watch. Depending on whether or not the crown is pushed in during the zero crossing of the time reference signal, additional actuation of the fast correction means is not required, or else it must be actuated at the zero crossing of a subsequent time reference signal.

Basically, the invention is not limited in its application to a watch having analog display hands, for the invention is also applicable to a watch with a digital display, in which event a minute and hour counter must be added to synchronous counter 12 and its additional counter 13. Furthermore, adequate logic and, if necessary, multiplying means would have to be inserted between these counters and the digital display means.

The Time Diagrams

Referring now to FIG. 2, the time diagrams I, II, and III show how the motor drive pulses are positioned and precisely defined with regard to their length.

Diagram I shows a triggering pulse and also a pulse whose trailing edge triggers the start of a motor drive pulse. The triggering pulse cannot start until the conclusion of the non-inhibited time interval during which resetting takes place. As described previously, the length of the inhibit interval, as illustrated in Diagram III, is determined by the corresponding symmetrical pulses of different frequency emerging from divider section 8 which are combined in gates 104 and 105 of the decoding logic. In the example shown in FIG. 2, the duration of the inhibition time interval is $\frac{1}{8}$th of a second plus the duration of the motor pulse, whereas the duration of the non-inhibited time interval is $\frac{7}{8}$ths of a second.

The location of the turn-off control pulses to effect motor reset is shown in Diagram II. It will be seen in Diagram III that the next turn-off pulse from flip-flop 119 occurs subsequent to the trailing edge of a trigger pulse, the turn-off pulse terminating a motor pulse and at the same time the inhibit interval. Diagram III also shows that the motor drive pulses alternate in polarity. The duration of the motor drive pulses is exaggerated for purposes of illustration.

While there has been shown and described a preferred embodiment of an electronic watch time correction system in accordance with the invention, it will be appreciated that many changes and modifications may be made therein without, however, departing from the essential spirit thereof.

We claim:

1. An electronic watch wherein high-frequency time base pulses are converted by the stages of a frequency divider into low-frequency pulses which are supplied through a control network to a stepping motor for advancing the hands of the time display, said watch being provided with a system for automatically effecting a rapid correction of the seconds hand display, comprising:

A. an actuating element accessible to the user and operatively coupled to a switch to activate same;

B. means connecting said switch through a reset line to several of the last stages of said divider to effect a reset thereof when said switch is activated;

C. a resettable reference counter coupled to the output of said frequency divider, said counter being connected to said reset line and being reset when said switch is activated;

D. a synchronous counter;

E. a logic circuit coupling said divider both to said synchronous counter and to the control network for the stepping motor to supply pulses thereto for advancing said display and for maintaining said synchronous counter in synchronism therewith;

F. A comparator circuit coupled to said reference and synchronous counters to determine whether a deviation exists therebetween and the extent of such deviation and to govern the number of pulses per unit of time that said logic circuit supplies to said control network and said synchronous counter to an extent correcting for said deviation, said logic circuit including means causing it to function as decoding logic to define a pulse transfer period which is no longer than the last quarter of the longest duration pulse period of the divider, said logic circuit being so connected to the outputs of the resettable divider stages that the transmission of pulses from the divider to the two counters can only be carried out during said pulse transfer period.

2. A watch as set forth in claim 1, wherein said actuating element is a push-button embedded in the case of the watch.

3. A watch as set forth in claim 1, wherein said logic circuit includes means to inhibit resetting of the frequency divider stages during the pulse transfer period.

4. A watch as set forth in claim 1, wherein said divider supplies 1 Hz pulses to said reference counter and 1 and 2 Hz pulses to said synchronous counter;

5. A watch as set forth in claim 1, wherein said logic circuit includes means to prevent a reset of said frequency divider stages as long as pulses are being transmitted to said control network for said stepping motor.

6. A watch as set forth in claim 1, wherein said control network for the stepping motor includes flip-flops set by the pulses supplied by said logic circuit, said flip-flops being reset by a continuous pulse train derived without interruption from stages of said divider preceding said final stages.

7. A watch as set forth in claim 6 further including a pulse length decoding circuit for positioning the edges of the pulses for resetting said flip-flops, thereby determining the length of the pulses applied to said stepping motor to drive same, said pulse length decoding circuit being connected to the outputs of several frequency divider stages preceding said final stage.

8. A watch as set forth in claim 7, wherein the connections between the outputs of said stages and the pulse length decoding circuit are selectable to determine the length of the pulses applied to said stepping motor.

9. A watch as set forth in claim 7, wherein said watch is provided with a crown for manually setting the hands of the time display and further including a second switch operatively coupled to said crown and activated thereby, said second switch being connected through a second reset line to several of the last stages of said divider to effect a reset thereof when said second switch is activated.

10. A watch as set forth in claim 9, wherein said divider includes an intermediate section immediately preceding the final section of the divider containing said last stages, and said second switch activated by the time-setting crown is connected through said second reset line to said intermediate section to effect a reset thereof when said second switch is activated, the stages of said intermediate section being connected to said pulse length decoding circuit.

11. A watch as set forth in claim 10, wherein said final section has five binary stages.

12. A watch as set forth in claim 11, wherein said switches are so connected via said reset lines to reset said reference counter and said synchronous counter whereby these counters can both be reset only by simultaneous activation of both switches.

13. A watch as set forth in claim 9, wherein said second switch is activated only when said crown is pulled out to its farthest position.

14. A watch as set forth in claim 1, wherein said frequency divider has at least two resettable multi-stage sections and one non-resettable dynamic mode section preceding the two sections.

15. A watch as set forth in claim 13, wherein the dynamic mode section has several stages which are activated by selective connections between the stages in accordance with the frequency of the time base whereby the output of the divider is the same for time bases of different frequency.

* * * * *